US011019887B1

(12) United States Patent
Huang

(10) Patent No.: US 11,019,887 B1
(45) Date of Patent: Jun. 1, 2021

(54) BELT BUCKLE

(71) Applicant: KOKO INTERNATIONAL CO., LTD., Huatan Township (TW)

(72) Inventor: Shang-Yu Huang, Huatan Township, Changhua County (TW)

(73) Assignee: KOKO INTERNATIONAL CO., LTD., Changhua County (TW)

( * ) Notice: Subject to any disclaimer, the term of this patent is extended or adjusted under 35 U.S.C. 154(b) by 0 days.

(21) Appl. No.: 16/780,887

(22) Filed: Feb. 3, 2020

(30) Foreign Application Priority Data

Jun. 28, 2019 (TW) ..... 108208406

(51) Int. Cl.
*A44B 11/06* (2006.01)

(52) U.S. Cl.
CPC ..... *A44B 11/06* (2013.01)

(58) Field of Classification Search
CPC .. A44B 11/06; Y10T 24/4072; Y10T 24/4016
See application file for complete search history.

(56) References Cited

U.S. PATENT DOCUMENTS 1,505,125 A * 8/1924 Armstrong ..... A44B 11/14 24/191
1,600,429 A * 9/1926 Sampson ..... A44B 11/14 24/191
2,598,369 A * 5/1952 Grandi ..... A44B 11/14 24/170
2,893,088 A * 7/1959 Harper ..... A44B 11/2526 24/638
3,179,992 A * 4/1965 Murphy, Sr. ..... A44B 11/2526 24/638
3,226,791 A * 1/1966 Garter ..... A44B 11/2526 24/644
4,185,363 A * 1/1980 David ..... B64D 17/32 24/645
5,097,572 A * 3/1992 Warrick ..... A44B 11/2503 24/645
5,615,459 A * 4/1997 Wu ..... A44B 11/14 24/170
5,806,145 A * 9/1998 Chen ..... A44B 11/14 24/170
5,857,247 A * 1/1999 Warrick ..... B64D 17/32 24/603
5,871,129 A * 2/1999 Boncompagni ..... A44B 11/005 224/163

(Continued)

*Primary Examiner* — Robert Sandy
*Assistant Examiner* — Louis A Mercado

(57) ABSTRACT

A belt buckle has a main body, a rotatable shaft assembly, an elastic member and a controlling member. The main body has a front piece and two side pieces paired and connected with each other. A shaft rod and a stopping portion and an arced edge are formed on the side piece. The elastic member is provided inside the rotatable shaft assembly and is pivoted together on the shaft rod. The controlling member uses its controlling ends to be pivoted on the shaft rod. When the toothed portion is pushed to rotate the rotatable shaft assembly, the engaging bar of the rotatable shaft assembly can slide along the arced edge of the side piece. At this time, the controlling end of the controlling member is not linked by the engaging bar, the controlling member can be fixed in place when the belt is penetrated.

6 Claims, 9 Drawing Sheets

(56) References Cited

U.S. PATENT DOCUMENTS

| | | | | |
|---|---|---|---|---|
| 6,427,291 | B1 * | 8/2002 | Kim | A44B 11/14 24/163 R |
| 6,868,587 | B2 * | 3/2005 | Rard | A44B 11/125 24/170 |
| 7,010,836 | B2 * | 3/2006 | Acton | A44B 11/2557 24/170 |
| 7,162,778 | B2 * | 1/2007 | Pan | A44B 11/20 24/170 |
| 7,263,750 | B2 * | 9/2007 | Keene | A44B 11/2526 24/265 B |
| 7,325,280 | B2 * | 2/2008 | Ichida | A44B 11/2557 24/170 |
| 8,052,170 | B2 * | 11/2011 | Pelliccia | B60R 22/20 280/808 |
| 8,302,266 | B2 * | 11/2012 | Chen | A44B 11/001 24/163 K |
| 9,351,526 | B1 * | 5/2016 | Taylor | A44B 11/16 |
| 9,770,073 | B2 * | 9/2017 | Ryou | A44B 11/16 |
| 9,775,410 | B2 * | 10/2017 | Szewczyk | B60R 22/30 |
| 10,219,585 | B2 * | 3/2019 | Taylor | A44B 11/2526 |
| 2016/0051014 | A1 * | 2/2016 | Resnick | A44B 11/16 368/232 |
| 2019/0281930 | A1 * | 9/2019 | Taylor | A44B 11/06 |
| 2020/0022461 | A1 * | 1/2020 | Huang | A44B 11/24 |

* cited by examiner

BELT BUCKLE

BACKGROUND OF INVENTION

Field of Invention

The present invention relates to a belt buckle, and more particularly to an easy-to-use belt buckle.

Description of the Related Art

Currently, the conventional belt buckle structure is composed of a belt and a belt buckle. One end of the belt is fixed the belt buckle, so that the free end of the belt can be passed through the belt buckle and fixed by the belt buckle. A ratchet plate is attached to the inner edge of the end of the belt and corresponding with the locking plate of the belt buckle, and the ratchet plate with different tooth positions can to control the position of the belt. In order to release the belt, the locking plate needs to be pushed to release the ratchet plate from the belt, so that the belt can be smoothly pulled away from the belt buckle. However, it is not difficult to find out that there are still some shortcomings in the conventional structure. The main reason is as follows: When the belt is passed through the belt buckle, the belt buckle is subject to the linkage between the belt and the locking plate and causes the belt buckle to move, and the movement of the belt buckle cause inconvenience in use.

Therefore, it is desirable to provide a belt buckle to mitigate and/or obviate the aforementioned problems.

SUMMARY OF THE INVENTION

An objective of present invention is to a belt buckle, which is capable of improving the above-mention problems.

In order to achieve the above mentioned objective, belt buckle has:

a main body having a front piece and two side pieces paired and connected with each other, an end of each side piece having a front opening, another end of each side piece having a rear opening, the two side pieces respectively having a shaft hole adjacent to the rear opening and accepting a shaft rod, each side piece further having a stopping portion and an arced edge around the shaft hole;

a rotatable shaft assembly having an upper rotating member and a lower rotating member, ends of the upper rotating member both the respectively having a first pivoting end pivoted with the shaft rod, the upper rotating member further having a toothed portion facing the front piece and a first stopping portion disposed opposite the toothed portion; ends of the lower rotating member respectively having a second pivoting end pivoted with the shaft rod to combine the upper rotating member with the lower rotating member; one side of the lower rotating member further having a second stopping portion, another side of the lower rotating member further having an engaging bar configured to slide along the stopping portion and the arced edge;

an elastic member disposed between the upper rotating member and the lower rotating member, the elastic member having a first elastic arm and a second elastic arm, the first elastic arm pushing against the first stopping portion of the upper rotating member to cause the toothed portion to face the front piece, the second elastic arm pushing against the second stopping portion of the lower rotating member to cause the engaging bar to face the stopping portion; and a controlling member surrounding the front piece of the main body and having two controlling ends corresponding to the shaft holes of the side pieces, the two controlling ends pivoted onto the shaft rod adjacent to the side pieces, the controlling end configured to push the engaging bar to rotate the rotatable shaft assembly to turn the toothed portion.

Other objects, advantages, and novel features of invention will become more apparent from the following detailed description when taken in conjunction with the accompanying drawings.

DETAILED DESCRIPTION OF THE PREFERRED EMBODIMENT

Figure 1:
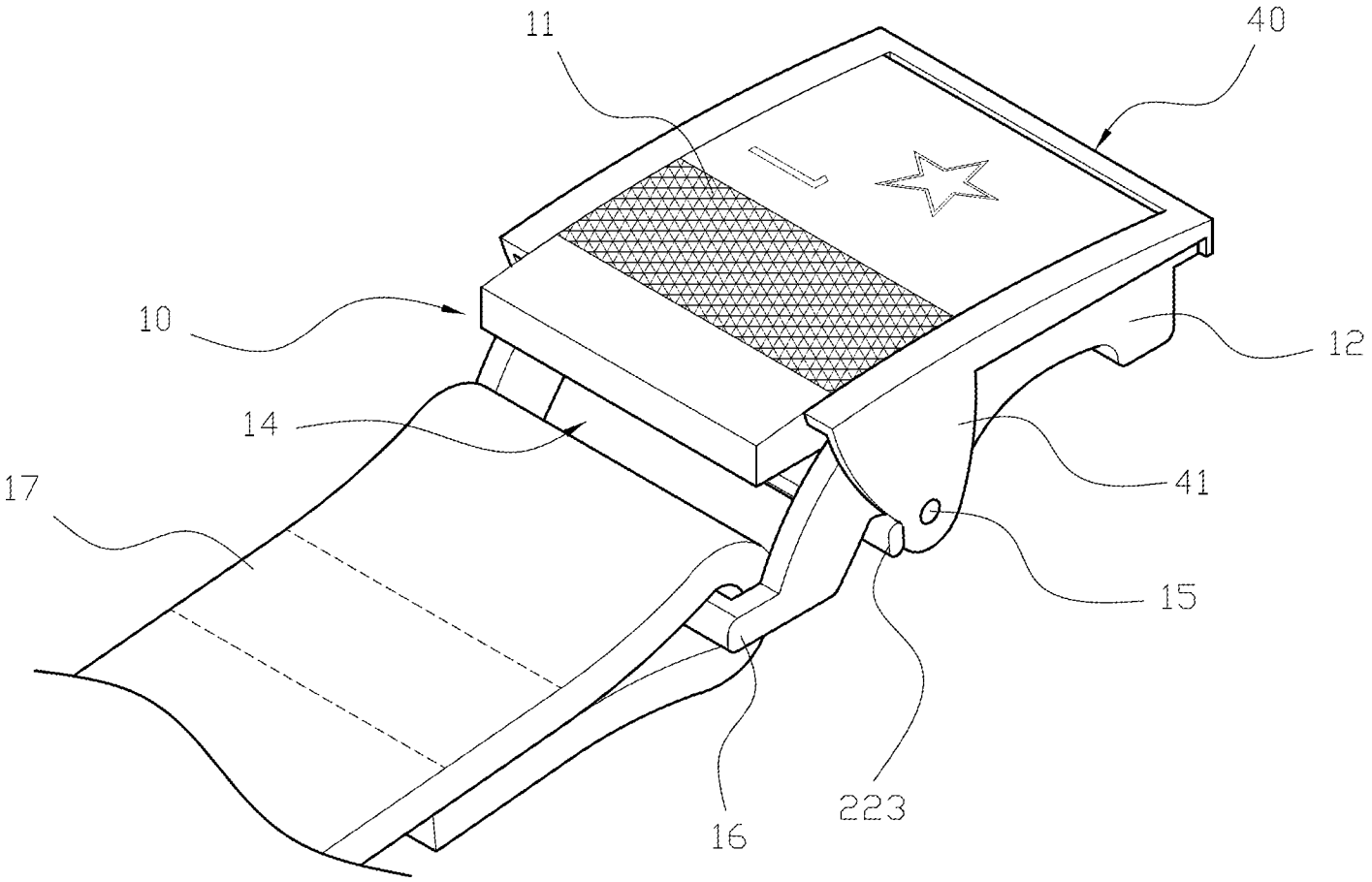
FIG. 1 is a three-dimensional view of a preferred embodiment of the present invention.
Figure 2:
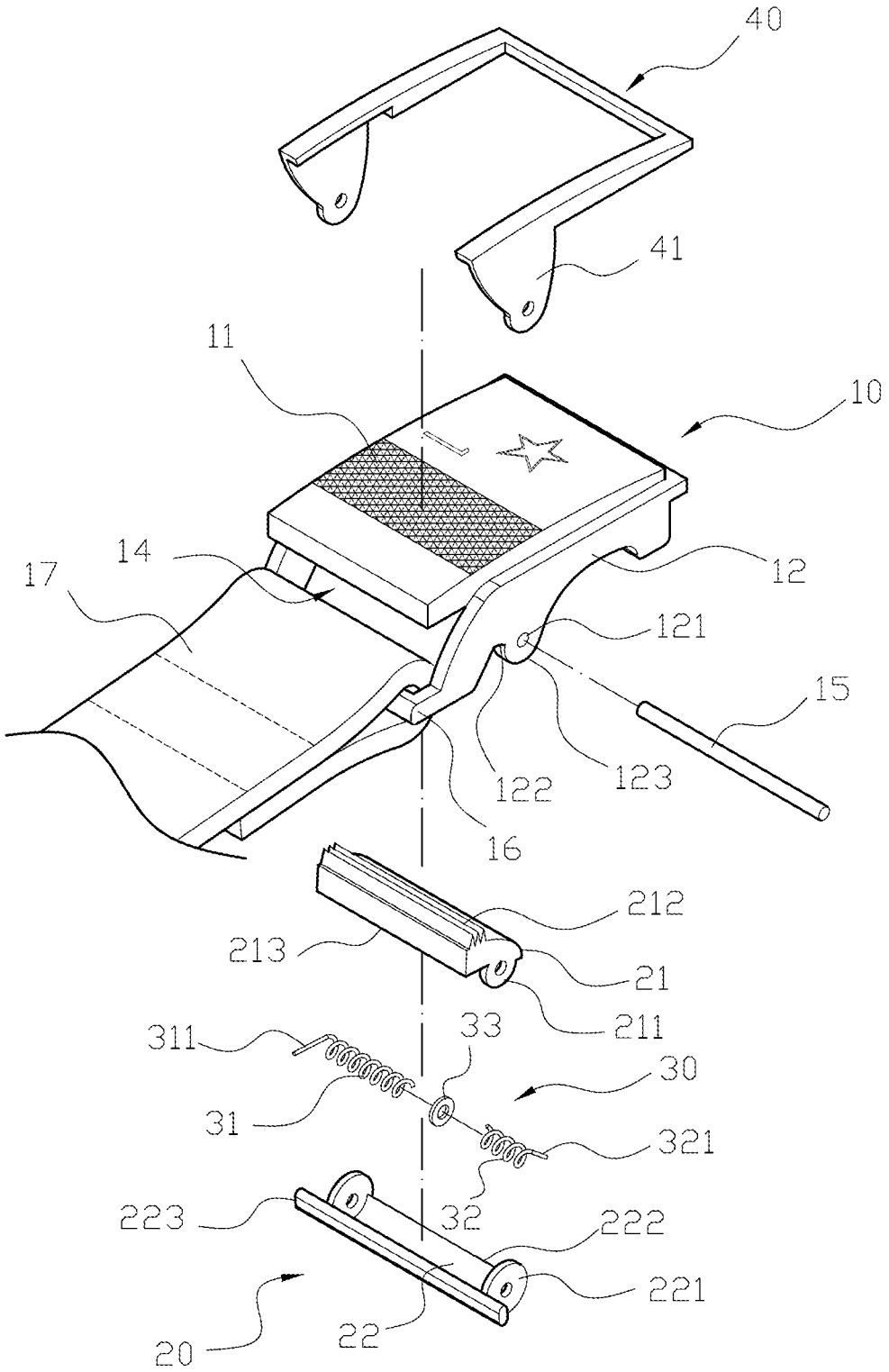
FIG. 2 is a three-dimensional exploded view of the preferred embodiment of the present invention.
Figure 3:
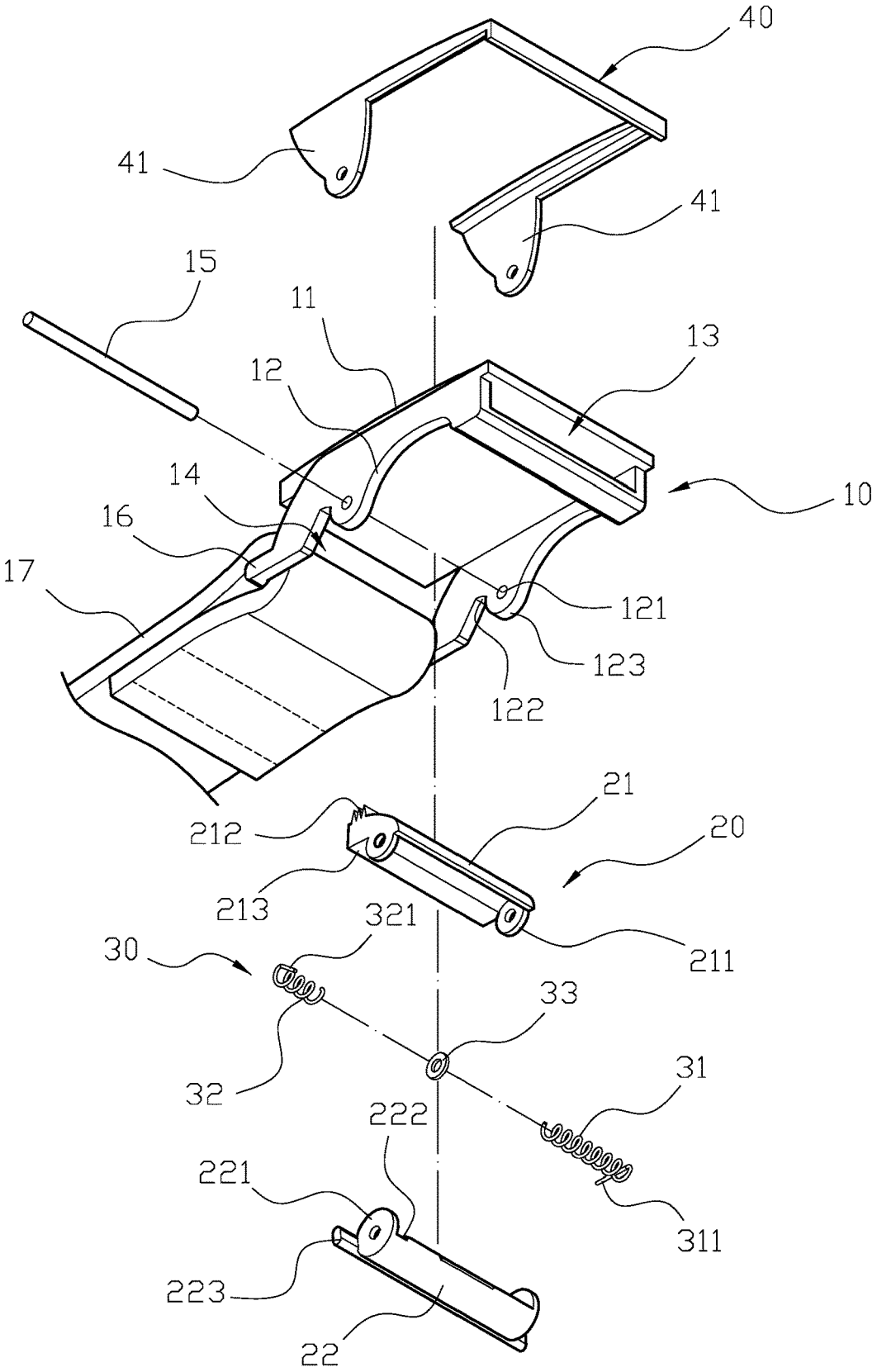
FIG. 3 is another three-dimensional exploded view of the preferred embodiment of the present invention.
Figure 4:
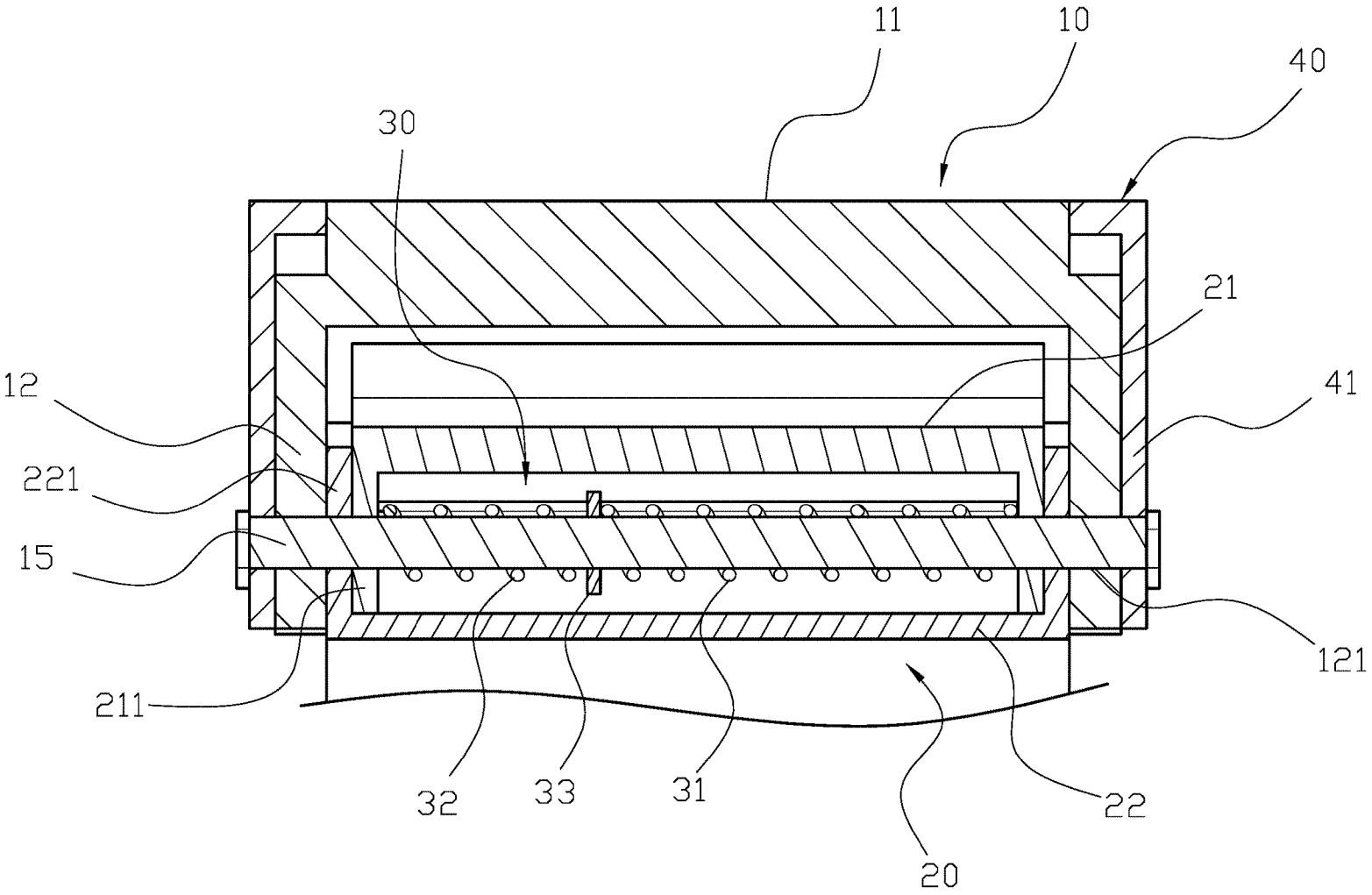
FIG. 4 is a sectional view of the preferred embodiment of the present invention.
Figure 5:
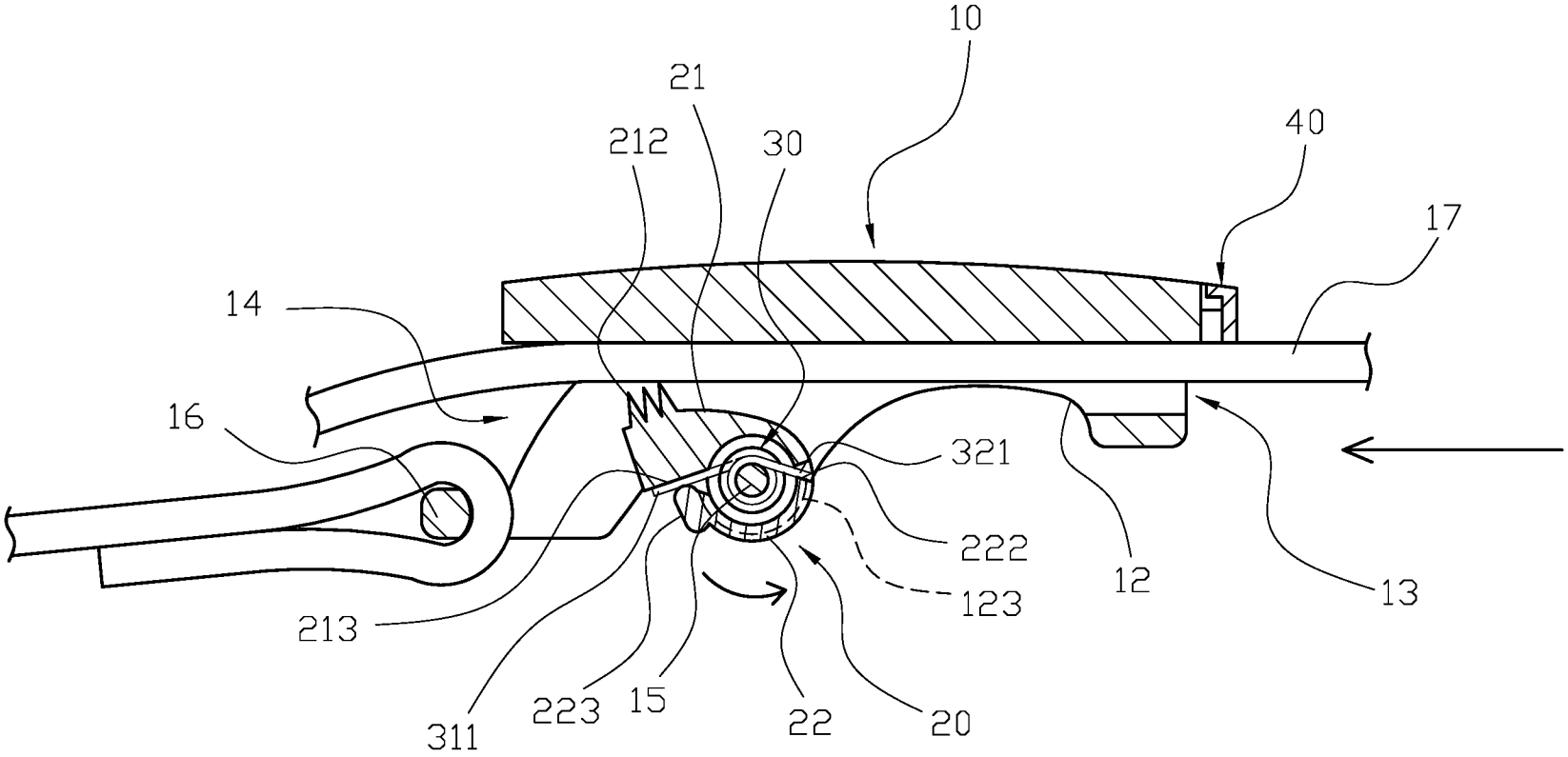
FIG. 5 is a sectional view of the use state of the preferred embodiment of the present invention.
Figure 6:
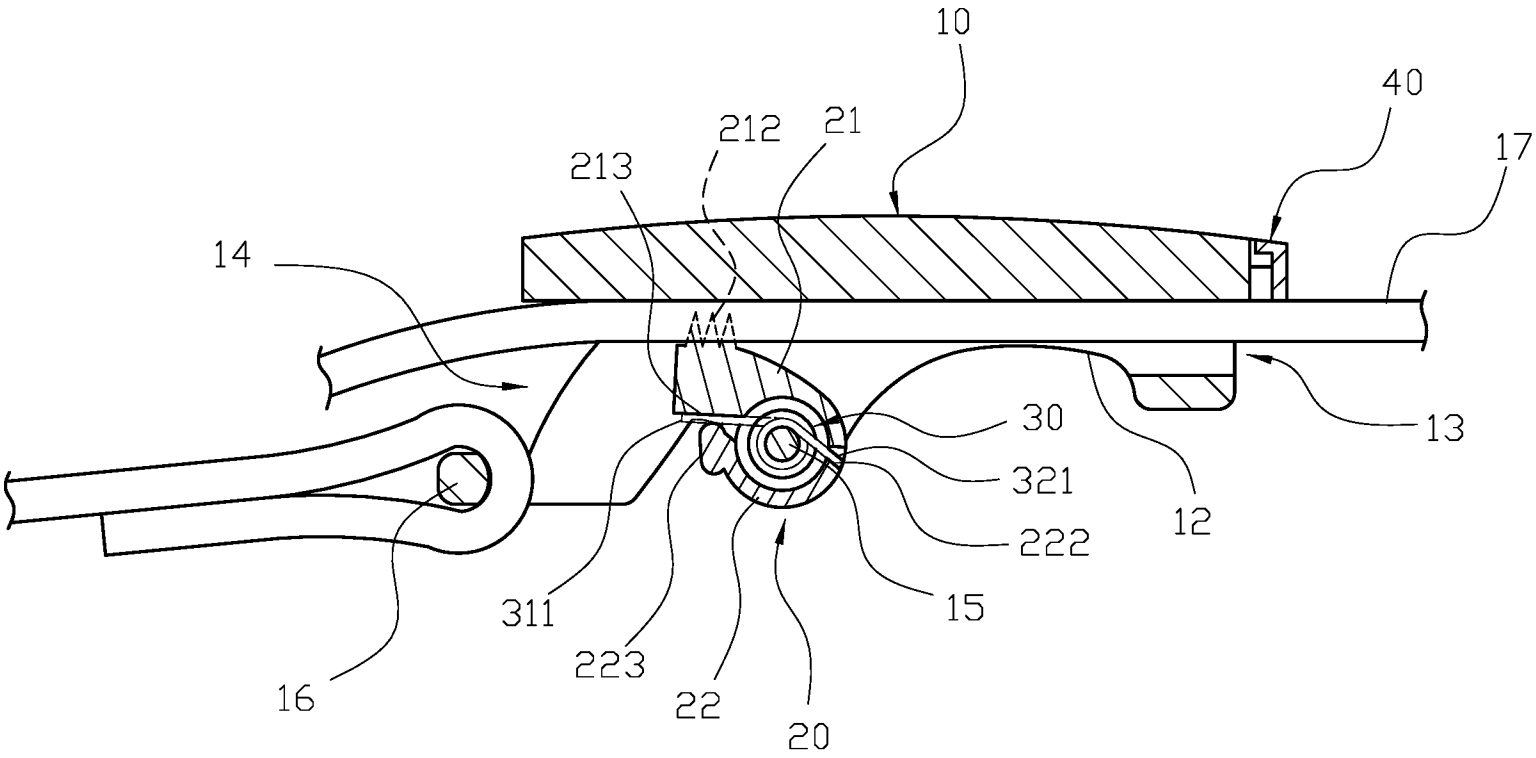
FIG. 6 is another sectional view of the state of use of the preferred embodiment of the present invention.
Figure 7:
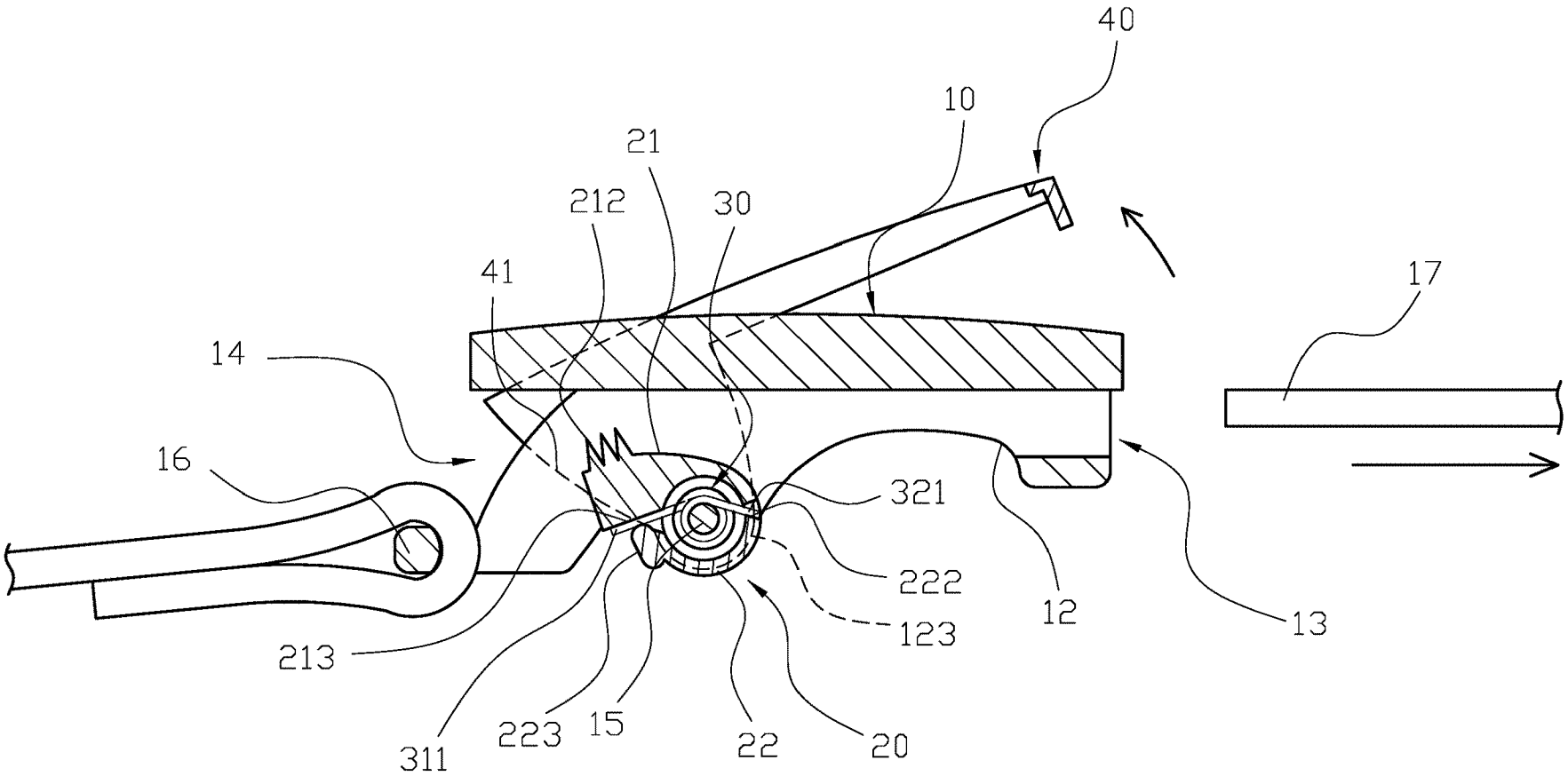
FIG. 7 is another cross-sectional view of the state of use of the preferred embodiment of the present invention.
Figure 8:
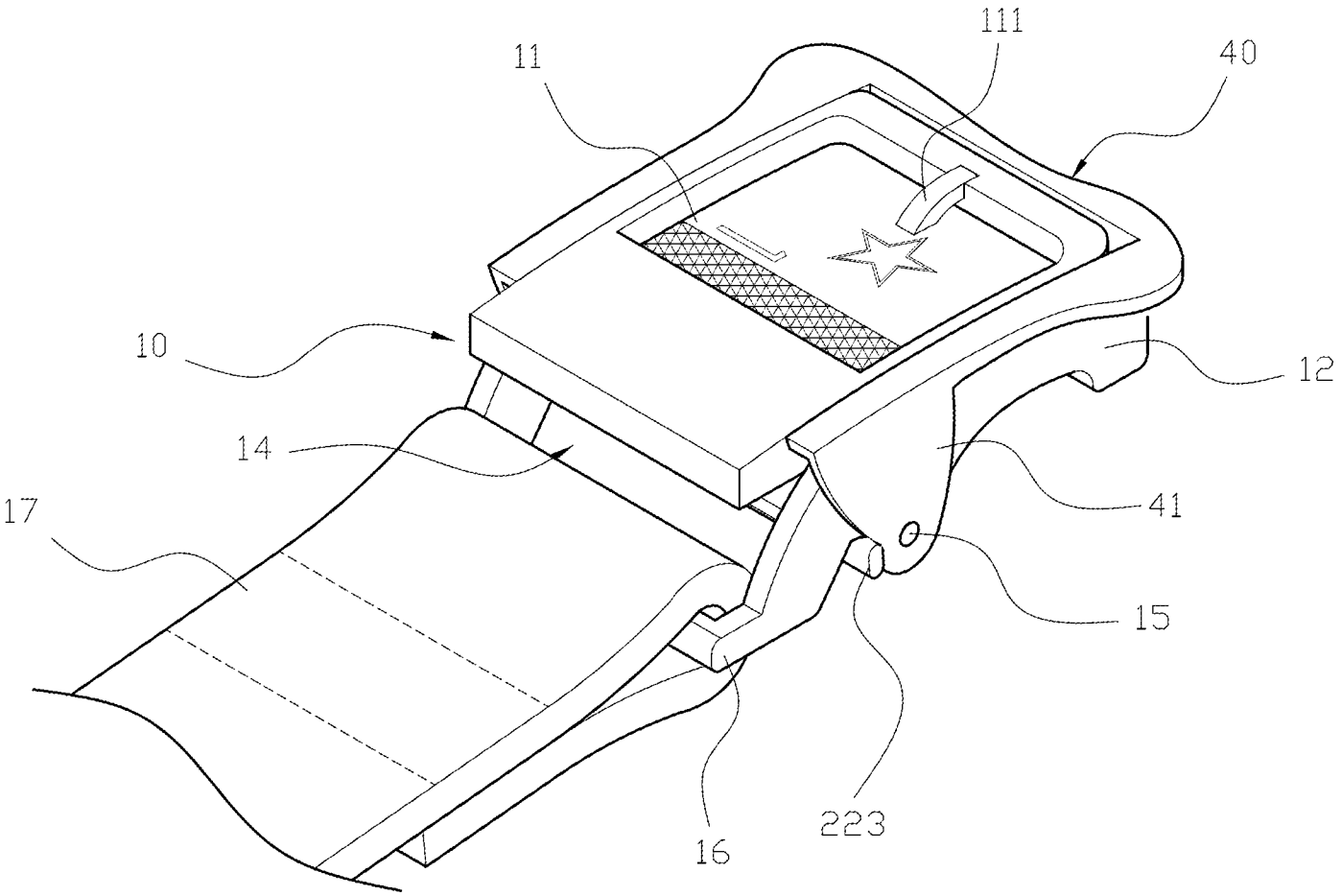
FIG. 8 is a perspective view of another embodiment of the present invention.
Figure 9:
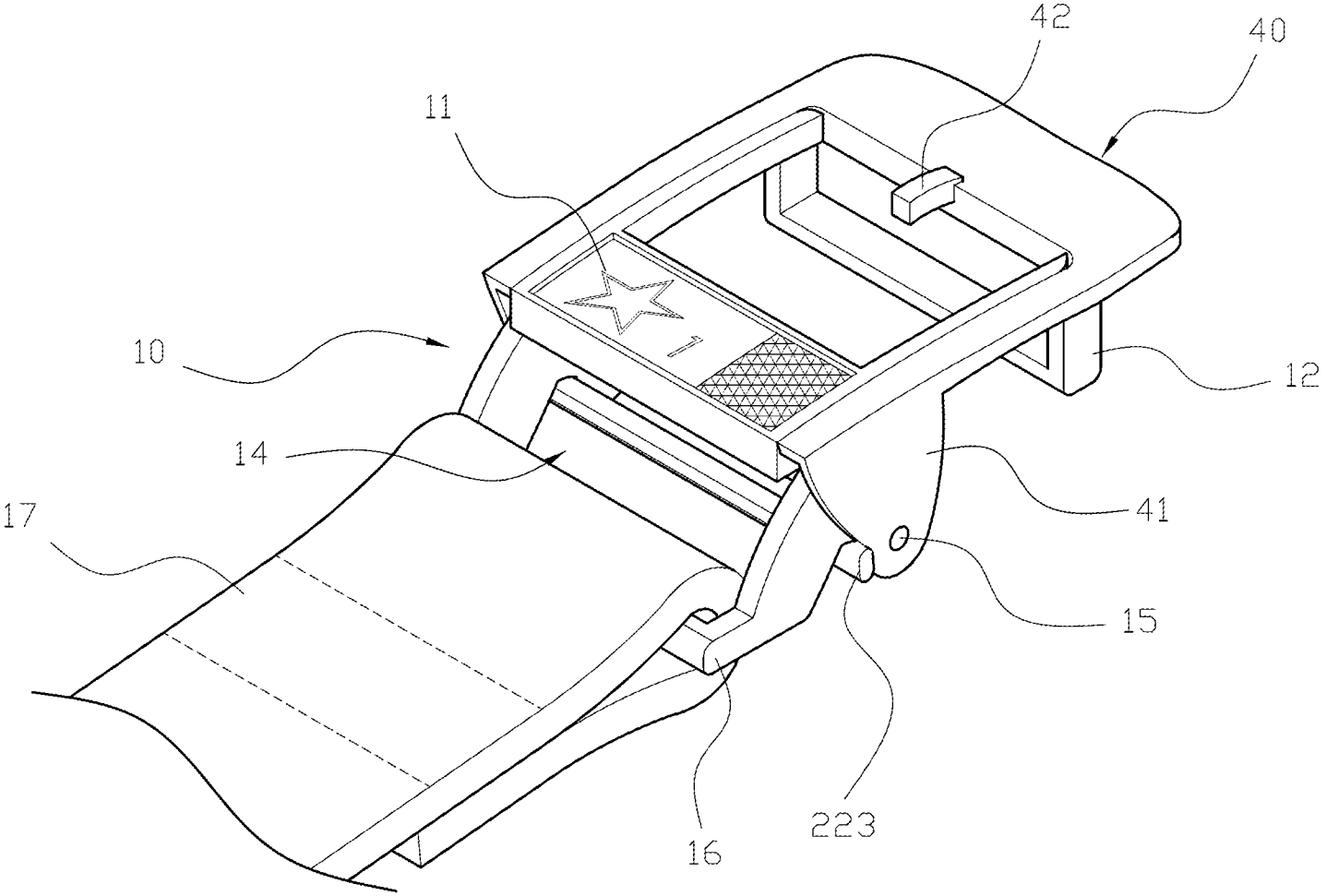
FIG. 9 is a perspective view of another embodiment of the present invention.

First, please refer to FIGS. 1-3. A belt buckle comprises: a main body 10, a rotatable shaft assembly 20, an elastic member 30 and a controlling member 40. The main body 10 has a front piece 11 and two side pieces 12 paired and connected with each other. The front piece 11 is provided with patterns, drawings, letters or designs, as shown in FIG. 8, and also a tongue 111. The main body 10 is presented as a faux tongue style. An end of each side piece 12 has a front opening 13, and another end of each side piece 12 has a rear opening 14. The two side pieces 12 respectively have a shaft hole 121 adjacent to the rear opening 14 and accepting a shaft rod 15. Each side piece 12 further has a stopping portion 122 and an arced edge 123 around the shaft hole 121. The rotatable shaft assembly 20 has an upper rotating member 21 and a lower rotating member 22. Ends of the upper rotating member 21 both respectively having a first pivoting end 211 pivoted with the shaft rod 15. The upper rotating member 21 further has a toothed portion 212 facing the front piece 11, and a first stopping portion 213 is disposed opposite the toothed portion 212. Ends of the lower rotating member 22 both respectively has a second pivoting end 221 pivoted with the shaft rod 15 to combine the upper rotating member 21 with the lower rotating member 22. One side of the lower rotating member 22 has a second stopping portion 222, and member further having an engaging bar configured to slide along the stopping portion and the arced edge lower rotating member 22 further have an engaging bar 223 configured to slide along the stopping portion 122 and the arced edge 123. An elastic member 30 is disposed between the upper rotating member 21 and the lower rotating member 22. The elastic member 30 has a first elastic arm 311 and a second elastic arm 321. 又 the first elastic arm 311 pushes against the first stopping portion 213 of the upper rotating member 21 to cause the toothed portion 212 to face the front piece 11. The second elastic arm 321 pushes against the second stopping portion 222 of the lower rotating member 22 to cause the engaging bar 223 to face the stopping portion 122. The elastic member 30 further has a first spring 31, a second spring 32 and a separating member 33. The separating member 33 is sandwiched between the first spring 31 and the second spring 32, the first elastic arm 311 is disposed on the first spring 31 away from an end of the separating member 33, and the second elastic arm 321 is disposed on the second spring 32 away from another end the separating member 33. The first spring 31 stronger or stiffer than the second spring 32. The controlling member 40 surrounds the front piece 11 of the main body 10 and has two controlling ends 41 corresponding to the shaft hole 121 of the side piece 12. The two controlling ends 41 are pivoted onto the shaft rod 15 adjacent to the side piece 12. As shown in FIG. 9, the controlling member 40 is provided with a tongue 42 such that the main body 10 has a faux tongue style. The controlling end 41 is configured to push the engaging bar 223 to rotate the rotatable shaft assembly 20 to turn the toothed portion 212. The main body 10 further comprises a connecting portion 16 at the rear opening 14, the connecting portion 16 is attached with a belt 17, and an end of the belt 17 passes through the front opening 13 and the rear opening 14 such that the toothed portion 212 of the upper rotating member 21 locks the belt 17.

For the structure assembly, please refer to FIG. 1 to FIG. 4. The separating member 33 of the elastic member 30 is sandwiched between the first spring 31 and the second spring 32. The elastic member 30 is installed in the upper rotating member 21 and the lower rotating member 22 of the rotatable shaft assembly 20, such that the first elastic arm 311 of the first spring 31 elastically presses the first stopping portion 213 of the upper rotating member 21, and the second elastic arm 321 of the second spring 32 presses the second stopping portion 222 of the lower rotating member 22. The relative compressions applied on the separating member 33 by the first spring 31 and the second spring 32 allows the rotatable shaft assembly 20 to have suitable and controllable elasticity, then the combination of the elastic member 30 and the rotatable shaft assembly 20 is disposed between the two side piece 12 of the main body 10, and the shaft rod 15 is passed through the shaft hole 121 of the side piece 12, the first pivoting end 211 of the upper rotating member 21, the second pivoting end 221 of the lower rotating member 22, the first spring 31, the separating member 33 and the second spring 32. Therefore, the rotatable shaft assembly 20 and the elastic member 30 are passed through the main body 10, the toothed portion 212 the upper rotating member 21 is turned toward to the front piece 11 of the belt buckle 10, and the engaging bar 223 of the lower rotating member 22 pushes against the stopping portion 122 of the side piece 12. Finally, the controlling member 40 is placed on the front piece 11 of the belt buckle 10, the shaft rod 15 is passed through the two controlling ends 41 of the controlling member 40, and the connecting portion 16 of the main body 10 is connected to the belt 17.

For the effect of actual use, please refer to FIG. 2 to FIG. 7. Before been used, the first elastic arm 311 of the first spring 31 elastically pushes against the first stopping portion 213 of the upper rotating member 21, and the second elastic arm 321 of the second spring 32 elastically pushes against the second stopping portion 222 of the lower rotating member 22. The first spring 31 and the second spring 32 are squeezed in the middle of the separating member 33 together, to form the relative elastic force for the first elastic arm 311 and the second elastic arm 321, the toothed portion 212 of the upper rotating member 21 is swung toward the front piece 11 of the main body 10, and the engaging bar 223 of the lower rotating member 22 is pressed against the stopping portion 122 of the side piece 12. Meanwhile, the upper rotating member 21 is blocked by the lower rotating member 22 to limit the upper edge of the toothed portion 212. Furthermore, when the belt 17 is passed through the front opening 13 of the main body 10 and pushes the toothed portion 212 to rotate towards to the rear opening 14 against the spring force of the first spring 31 and push away the toothed portion 212 to rotate the lower rotating member 22 synchronously, so that the engaging bar 223 slides the arced edge 123 of the side piece 12 and the belt 17 can be smoothly passed out of the rear opening 14, and then the belt 17 is locked by the toothed portion 212 to form a reverse bite. Moreover, when the belt 17 is passed through the main body 10, the toothed portion 212 is pushed to rotate the upper rotating member 21, the engaging bar 223 slides along the arced edge 123 of the side piece 12, while the rotatable shaft assembly 20 and the elastic member 30 are rotating, the controlling end 401 of the controlling member 40 is not affected by the engaging bar 223. Therefore, the controlling member 40 holds still when the belt 17 is passed, which allows the belt 17 to be passed easily. Alternatively, when the belt 17 needs to be removed, the controlling member 40 is pushed to rotate around the shaft rod 15 and the controlling end 41 pushes the engaging bar 223 of the rotatable shaft assembly 20, thereby simultaneously the toothed portion 212 of the upper rotating member 21 is pushed open to releases the toothed portion 212 from the belt 17, and the belt 17 can be easily pulled away from the main body 10.

With the structure of the above specific embodiment, the following benefits can also be obtained: the first elastic arm 311 of the first spring 31 elastically pushes on the first stopping portion 213 of the upper rotating member 21, the second elastic arm 321 of the second spring 32 elastically pushes against the second stopping portion 222 of the lower rotating member 22, and the first spring 31 and the second spring 32 sandwich the separating member 33 in-between to provide elastic force to the first elastic arm 311 and the second elastic arm 321. Since the first spring 31 is stronger than the second spring 32, the first elastic arm 311 provides a stronger thrust on the upper rotating member 21, the elastic member 30 assembled in the rotatable shaft assembly 20 is capable of generating sufficient thrust force. Therefore, the overall structure is simplified, and the elastic member 30 is effectively protected for more stable movement which improves its durability.

Although the present invention has been explained in relation to its preferred embodiment, it is to be understood that many other possible modifications and variations can be made without departing from the spirit and scope of invention as hereinafter claimed.

What is claimed is:

1. A belt buckle comprising:

a main body having a front piece and two side pieces paired and connected with each other, an end of each of the side pieces having a front opening, another end of each of the side pieces having a rear opening, the two side pieces respectively having a shaft hole adjacent to the rear opening and accepting a shaft rod, each of the side pieces further having a stopping portion and an arced edge around the shaft hole;

a rotatable shaft assembly having an upper rotating member and a lower rotating member, ends of the upper rotating member respectively having a first pivoting end pivoted with the shaft rod, the upper rotating member further having a toothed portion facing the front piece and a first stopping portion disposed opposite the toothed portion, ends of the lower rotating member respectively having a second pivoting end pivoted with the shaft rod to combine the upper rotating member with the lower rotating member, one side of the lower rotating member further having a second stopping portion, another side of the lower rotating member further having an engaging bar configured to slide along the stopping portion and the arced edge;

an elastic member disposed between the upper rotating member and the lower rotating member, the elastic member having a first elastic arm and a second elastic arm, the first elastic arm pushing against the first stopping portion of the upper rotating member to cause the toothed portion to face the front piece, the second elastic arm pushing against the second stopping portion of the lower rotating member to cause the engaging bar to face the stopping portion; and a controlling member surrounding the front piece of the main body and having two controlling ends corresponding to the shaft holes of the side pieces, the two controlling ends pivoted onto the shaft rod adjacent to the side pieces, the controlling ends configured to push the engaging bar to rotate the rotatable shaft assembly to turn the toothed portion.

2. The belt buckle as claimed in claim 1, wherein the main body further comprises a connecting portion at the rear openings, the connecting portion is attached with a belt, an end of the belt passes through the front openings and the rear openings such that the toothed portion of the upper rotating member locks the belt.

3. The belt buckle as claimed in claim 1, wherein the elastic member further comprises a first spring, a second spring, and a separating member, the separating member sandwiched between the first spring and the second spring, the first elastic arm disposed on the first spring away from an end of the separating member, the second elastic arm disposed on the second spring away from another end of the separating member, and the first spring is stronger or stiffer than the second spring.

4. The belt buckle as claimed in claim 1, wherein the front piece is provided with patterns, drawings, letters or designs.

5. The belt buckle as claimed in claim 1, wherein the front piece is further provided with a tongue.

6. The belt buckle as claimed in claim 1, wherein the controlling member is further provided with a tongue.

* * * * *